United States Patent [19]

Barbour

[11] Patent Number: 4,802,927

[45] Date of Patent: Feb. 7, 1989

[54] BEVERAGE CAN CLEANER

[76] Inventor: Gary W. Barbour, 2108 E. St., Box 64, Chalmers, Ind. 47929

[21] Appl. No.: 51,616

[22] Filed: May 20, 1987

[51] Int. Cl.[4] ..... B08B 1/00

[52] U.S. Cl. ..... 134/6; 15/211; 15/244.4

[58] Field of Search ..... 15/70, 101, 244.1, 244.4, 15/210 R, 211

[56] References Cited

U.S. PATENT DOCUMENTS

| | | | |
|---|---|---|---|
| 282,434 | 7/1883 | Barker | 15/70 |
| 1,100,367 | 6/1914 | Gambill | 15/244.1 |
| 2,832,087 | 4/1958 | McEwan | 15/224.1 X |
| 3,161,903 | 12/1964 | Worthington | 15/244.1 X |
| 3,939,514 | 2/1976 | Cook | 15/70 X |
| 4,053,242 | 10/1977 | Mast, Jr. | 15/244 R X |
| 4,165,815 | 8/1979 | Vetter | 15/244.1 X |
| 4,346,495 | 8/1982 | Lin | 15/184 |
| 4,411,040 | 10/1983 | Sharrow et al. | 15/244.1 X |
| 4,412,365 | 11/1983 | Schmitt | 15/184 |

*Primary Examiner*—Chris K. Moore

*Attorney, Agent, or Firm*—Woodard, Emhardt, Naughton, Moriarty & McNett

[57] ABSTRACT

A cleaning device includes a sponge material which has a pair of concentric upwardly extending cleaning ribs. The ribs define a cleaning groove sized to receive the upwardly extending rim of a beverage can. The device is pressed against the top of a beverage can and is twisted thereagainst with the rim of the can pressed into the groove of the sponge. A container having walls, a bottom and a lid is provided for storing, grasping and twisting the sponge material. The container includes means for holding the sponge material rotatably immobile relative to the container.

27 Claims, 3 Drawing Sheets

BEVERAGE CAN CLEANER

FIELD OF THE INVENTION

This invention relates to the field of cleaning devices, and in particular to a device for cleaning the top of a cola or beverage can.

BACKGROUND OF THE INVENTION

Modern technology has made it possible for soft drinks, sodas and the like to be purchased and consumed in places other than a soda fountain. Prepackaging of single servings has made it convenient for the consumer to open and drink the beverage right from the container. While the techniques of packaging have also assured freshness and carbonation of the beverage, they have not assured the cleanliness of that portion of the container which comes in contact with the consumer's mouth. Before reaching the hands of the buyer, beverage bottles and cans pass from the bottling plant into warehouses, onto trucks and into supermarkets, restaurants or beverage machines. Throughout the entire journey, practically the entire bottle or can exterior is exposed to all forms of contaminants. During storage and transport, some bottles and cans tend to explode or break, often spreading the beverage over the adjacent bottles or cans. The drying residue is usually sticky, tending to attract even more dust and contaminants.

The "mouth-contact" portion of a beverage can, unlike that of a bottle, has an irregular contour making it difficult to clean off with a paper towel or shirt tail. The small, recessed groove just inside of the upwardly extending rim at the top of most beverage cans is often a reservoir of tiny particles which elude even the most persistent cleaning.

What is needed is a small, compact device which can clean off the entire top of the can, including the recessed groove and which is inexpensive and easy to use.

SUMMARY OF THE INVENTION

Generally speaking, there is provided a cleaning device for beverage cans which is compact, self-contained, easy to use and economical. According to one embodiment, the cleaning device includes a sponge material which has a pair of concentric upwardly extending cleaning ribs. The ribs define a cleaning groove sized to receive the upwardly extending rim of a beverage can. The device is pressed against the top of the beverage and twisted thereagainst with the rim of the can pressed into the groove of the sponge. A container having walls, a bottom and a lid is also provided for storing, grasping and twisting the sponge material. The container includes means for holding the sponge material rotatably immobile relative to the container. There is also provided a means for opening the pull tab of the beverage can.

It is an object of the present invention to provide a device which clean the irregular surfaces at the top of a beverage can.

It is another object of the present invention to provide a device for cleaning the top of a beverage can which device is compact and inexpensive.

It is yet another object of the present invention to provide a device which is easy to use and easy to clean.

These and further objects of the invention will become apparent from the following description.

DESCRIPTION OF THE PREFERRED EMBODIMENT

Figure 1:
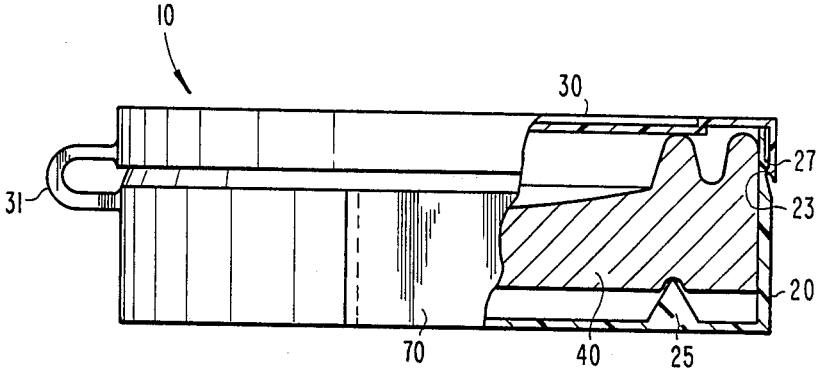
FIG. 1 is a side view, partly in section, of the beverage can cleaner in accordance with one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 3:
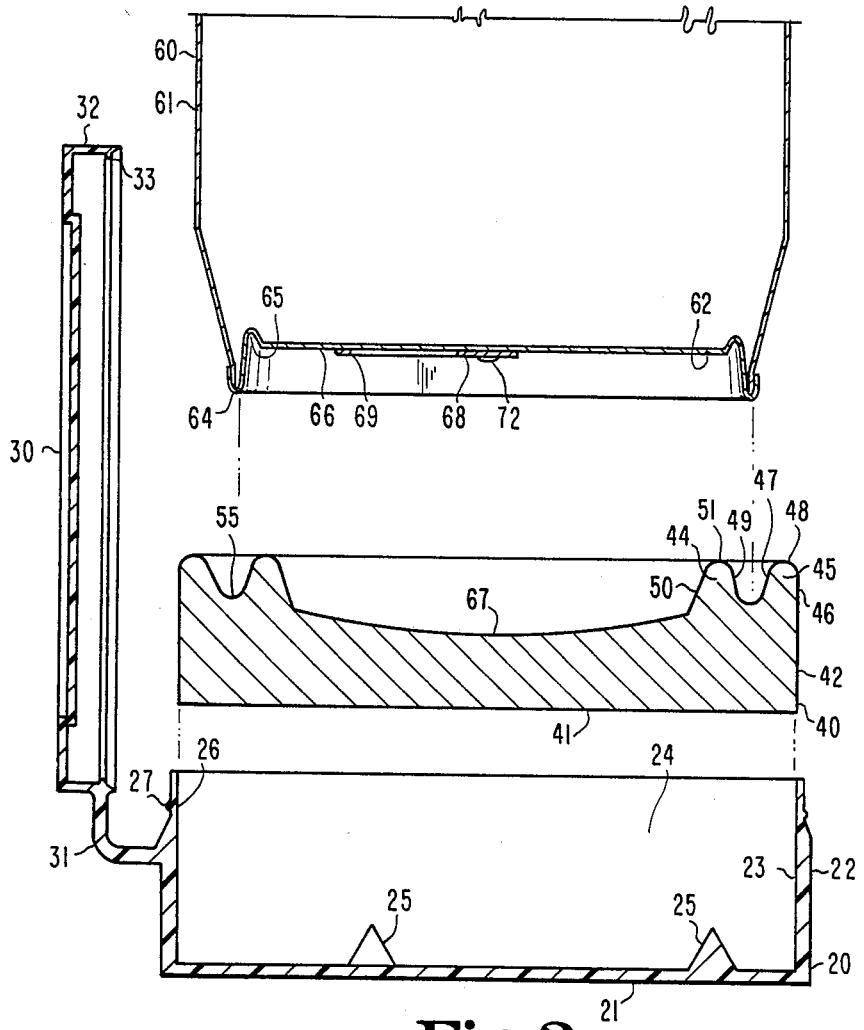
FIG. 3 is an exploded side view in cross-section of the beverage can cleaner of FIG. 1.

Referring now to the drawings, there is shown a cola can cleaner 10 in accordance with one embodiment of the present invention. Cleaner 10 includes a container 20, a lid 30 and a cleaning sponge 40. Cleaning sponge 40 is generally cylindrical having a flat bottom 41 and cylindrical sides 42 (FIG. 3). The top surface of sponge 40 includes a pair of concentric upwardly extending ribs 44 and 45. The outer surface 46 of rib 45 is a cylindrical extension of cylindrical sides 42. Inner surface 47 of rib 45 is frustoconical diverging slightly upward. Outer surface 46 and inner surface 47 converge to form an annular arcuate peak surface 48. Inner surface 50 and outer surface 49 of rib 44 are each fustoconical with surfaces 49 and 50 converging upwardly where they form another annular arcuate peak surface 51. Inner surface 47 of rib 45 and outer surface 49 of rib 44 converge downwardly to form annular rim-receiving groove 55.

The typical beverage can 60 has cylindrical side walls 61 and a top 62. Side walls 61 and top 62 are generally joined together with a spiraling fold which forms cylindrical rim 64 at the top of can 60. Most such beverage cans also contain an annular groove 65 located just inside and adjacent to rim 64. It is generally in groove 65, on rim 64 or on top surface 66 of top 62 where dirt and other contaminants settle prior to consumption.

In use, can 60 is axially aligned and brought in contact with sponge 40 bringing rim 64 between ribs 44 and 45. Exertion of a slight compressive force between can 60 and sponge 40 will cause rim 64 to burrow into groove 55. This will also cause inner rib 44 to burrow into groove 65 of can 60. The pressure of the end of rim 64 into groove 55 also causes deformation of sponge 40 such that inner surface 47 of rib 45 and outer surface 49 of rib 44 are forced against the inner and outer surfaces of rim 64 of can 60. Relative rotation between can 60 and sponge 40 about their common axis will cause the aforementioned surfaces of sponge 40 to rub against and clean rim 64 and groove 65. Exertion of slightly more than minimal pressure of sponge 40 against the top of can 60 will also cause central surface 67 of sponge 40 to contact and clean top surface 66 of can 60. Central surface 67, which is bounded by inner rib 44, is slightly concave to minimize contact, pressure and ripping of pull tab 68 against surface 67.

To facilitate storage and ease of use and to provide additional support for the sponge surfaces, container 20 is provided. Container 20 includes bottom 21 and cylindrical side walls 22 creating a cylindrical well 24 for receipt of sponge 40. The interior diameter of side walls 22 is approximately identical to the outside diameter of sponge 40. When sponge 40 is received within container 20, the entire surface of sides 42 and of outside surface 46 of rib 45 are in contact with interior surface 23 of side walls 22.

To keep sponge 40 rotatably immobile within container 20, a series of conical spikes 25 extend upwardly from bottom 21 of container 20. In the preferred embodiment, there are three such spikes 25 radially spaced about bottom 21. In a non-use position, sponge 40 sits right on top of spikes 25 within container 20 (FIG. 1). Side walls 22 of container 20 are high enough that sponge 40, in the rest or non-use position, does not extend above walls 22.

Lid 30 is provided to close container 20 and is hingedly attached thereto by resilient hinge 31. Upper portion 26 of side walls 22 has a slightly smaller outer diameter for receipt within side walls 32 of lid 30. Lid 32 is snappingly engagable to cover the opening of container 20 via interiorly extending annular flange 33 of lid 30 and exteriorly extending annular flange 27 of container 20 (FIGS. 1 and 3). The outside diameter of flange 27 is slightly larger than the inside diameter of flange 33 so that upper portion 26 and side walls 32 will deform slightly when lid 30 is compressed onto container 20, thus detachably locking lid 30 onto container 20 as flange 33 passes over and below flange 27.

Figure 4:
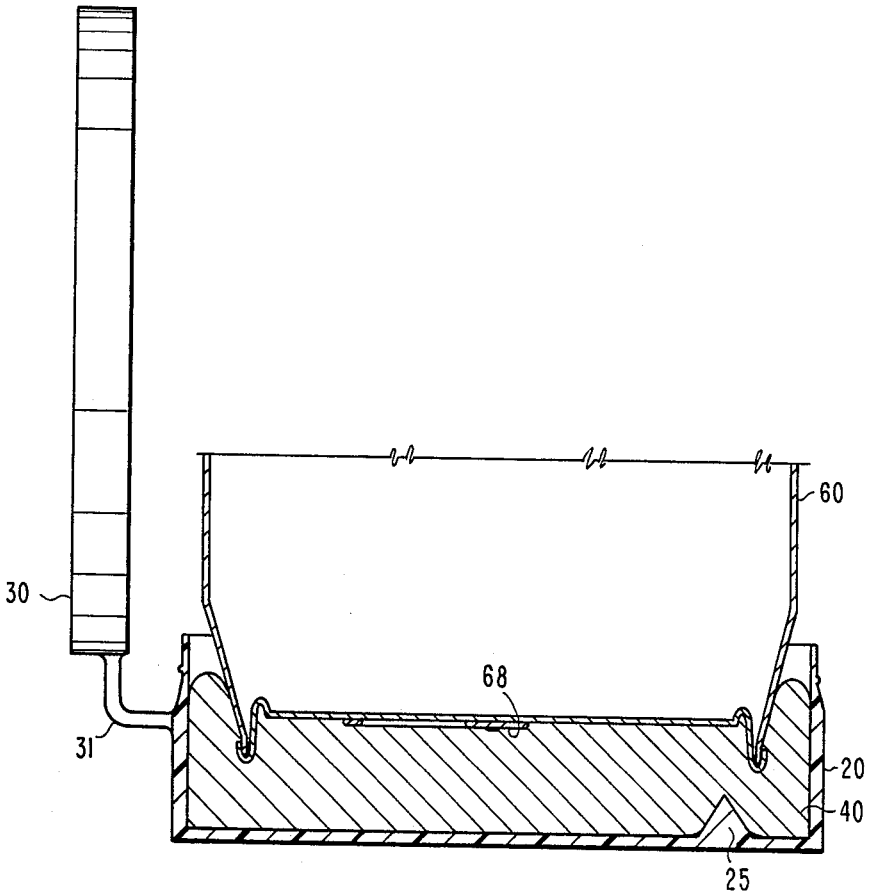
FIG. 4 is a side view in cross-section of the beverage can cleaner of FIG. 1 in actual use.

In use, lid 30 is flipped open revealing sponge 40. Top 62 of can 60 is brought in contact with sponge 40 so that rim 64 burrows into groove 55. Radially spaced spikes 25 are forced against bottom 41 of sponge 40 precluding rotation of sponge 40 relative to container 20. The peaks of spikes 25 are not brought to a point, but are rounded off just enough so that they do not rip sponge 40 apart each time the cleaning device is used. The pressure between can 60 and sponge 40 causes ribs 44 and 45, groove 55 and central surface 67 to conform to the top areas of can 60 at almost every point (FIG. 4). Grasping of container 20 firmly and twisting can 60 relative to container 20 will cause can 60 to rotate with respect to sponge 40.

Figure 2:
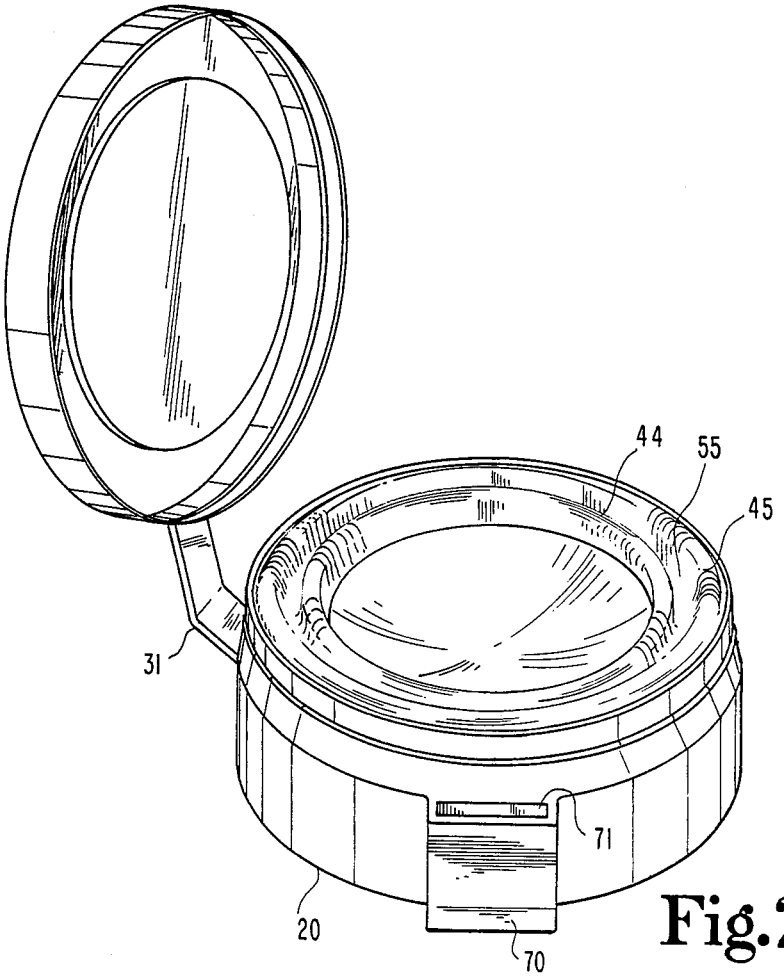
FIG. 2 is a perspective view of the beverage can cleaner of FIG. 1 with the lid open.

Attached to the exterior of walls 22 of container 20 is pull tab puller 70 (FIG. 2). The walls of puller 70 define a substantially rectangular slot 71 for receiving the finger portion of a conventional pull tab 68 (FIG. 3). With lid 30 closed, container 20 is maneuvered so that finger portion 69 slides into slot 71. Container 20 is then rocked toward pivot point 72 of pull tab 68 thus opening the can.

Container 20, lid 30 and pull tab puller 70 are all made of a resilient plastic such as polyethylene or polyurethane. Sponge 40 is made of a conventional sponge material which remains substantially soft when dry. After a number of uses of beverage can cleaner 10, when sponge 40 becomes soiled, the sponge may be removed easily from container 20 by pulling the sponge directly upwards. Sponge 40 may be cleaned in a conventional manner and returned to container 20 for further use.

In other embodiments, the means for providing rotatable immobility between sponge 40 and container 20 may be provided by just two spikes 25 or by more than three spikes 25. Alternatively, instead of spikes, the bottom surface may be roughened or contoured or the inside surface 23 of side walls 22 may include interiorally extending spikes.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A device for cleaning the top of a beverage can, comprising:

a container having walls and a bottom, said walls defining an opening opposite said bottom;

absorbent resilient cleaning means received within said container for cleaning the top of beverage cans, said cleaning means having an upwardly facing cleaning portion, the cleaning portion including an upwardly extending exterior annular rib, an upwardly extending interior annular rib and an annular groove therebetween, and wherein both said exterior and interior ribs have a cross-section substantially that of a frustum; and, gripping means fixed within said container for holding said cleaning means rotatably immobile relative to said container.

2. The device for cleaning the top of a beverage can of claim 1 wherein said gripping means is a plurality of upwardly extending spikes.

3. The device for cleaning the top of a beverage can of claim 2 wherein said spikes are radially spaced about the bottom.

4. The device for cleaning the top of a beverage can of claim 1 further including a lid hingedly attached to said container.

5. The device for cleaning the top of a beverage can of claim 4 wherein said container and said lid are made of plastic.

6. The device for cleaning the top of a beverage can of claim 1 wherein the walls of said container define an interior configuration and wherein said cleaning means has a base portion having a shape approximately identical to the interior configuration.

7. The device for cleaning the top of a beverage can of claim 6 wherein the cleaning portion of said cleaning means is a sponge material.

8. The device for cleaning the top of a beverage can of claim 7 wherein the cleaning portion further includes a central concave portion bounded by said interior annular rib.

9. A device for cleaning the top of a beverage can, comprising:

a container having walls and a bottom, said walls defining an opening opposite said bottom;

a lid hingedly attached to said container, wherein said lid has an interiorly extending flage and said walls have an exteriorly extending flange for engagement with the interiorly extending flange for detachably locking said lid with said container, absorbent, resilient cleaning means received within said container for cleaning the top of beverage cans, said cleaning means having an upwardly facing cleaning portion, the cleaning portion including an upwardly extending exterior annular rib, and upwardly extending interior annular rib and an annular groove therebetween; and gripping means fixed within said container for holding said cleaning means rotatably immobile relative to said container.

10. A device for cleaning the top of a beverage can having a pull tab, comprising:

a container having walls and a bottom, said walls defining an opening opposite said bottom;

absorbent, resilient cleaning means received within said container for cleaning the top of beverage cans, said cleaning means having an upwardly facing cleaning portion, the cleaning portion including an upwardly extending exterior annular rib, an upwardly extending interior annular rib and an annular groove therebetween;

gripping means fixed within said container for holding said cleaning means rotatably immobile relative to said container.

11. The device for cleaning the top of a beverage can of claim 10 wherein the pull tab means is rigidly mounted to the exterior of said walls and defines a slot having a generally rectangular cross-section.

12. A device for cleaning the top of a beverage can, comprising:

resilient absorbent cleaning means having a cleaning portion and a base portion, the cleaning portion including an interior upwardly extending annular cleaning rib, an exterior upwardly extending annular cleaning rib and a rim-receiving groove disposed therebetween and wherein both said interior and exterior ribs have a cross-section substantially that of a frustrum.

13. The device for cleaning the top of a beverage can of claim 12 wherein said cleaning means is sponge material.

14. The device for cleaning the top of a beverage can of claim 13 further including a holder for said cleaning means, said holder having walls and a bottom, the walls defining an opening opposite the bottom, the walls and bottom defining a cavity, said cleaning means shaped substantially the same as the cavity and received within said cavity with the cleaning portion facing away from the bottom of said holder.

15. The device for cleaning the top of a beverage can of claim 14 wherein said holder includes gripping means for holding said cleaning means relatively rotatably immobile in said holder during the cleaning of the top of the beverage can.

16. The device for cleaning the top of a beverage can of claim 15 wherein said gripping means includes a plurality of spikes extending from the bottom of said holder.

17. The device for cleaning the top of a beverage can of claim 16 further including covering means attached to said holder for covering the opening of said holder.

18. A device for cleaning the top of a beverage can, comprising:

sponge material having a cleaning portion and a base portion, the cleaning portion including an interior upwardly extending annular cleaning rib, an exterior upwardly extending annular cleaning rib and a rim receiving groove disposed therebetween;

a holder for said sponge material, said holder having walls and a bottom, the walls defining an opening opposite the bottom, the walls and bottom defining a cavity, said sponge material shaped substantially the same as the cavity and received within said cavity with the cleaning portion facing away from the bottom of said holder, wherein said holder includes gripping means for holding said sponge material relatively rotatably immobile in said holder during the cleaning of the top of the beverage can and wherein said gripping means includes a plurality of spikes extending from the bottom of said holder; and, a lid hingedly attached to said holder for covering the opening of said holder and wherein said lid has an inwardly extending flange and wherein the walls of said holder have an outwardly extending flange.

19. The device for cleaning the top of a beverage can of claim 18 wherein said lid has a detachably closed position wherein the inwardly extending flange is disposed below the outwardly extending flange with said lid in sealing engagement over said opening and wherein said lid has an opening position wherein said lid is away from the opening yet still hingedly connected to said holder and wherein said body and said lid are plastic.

20. The device for cleaning the top of a beverage can of claim 19 wherein said body has an exterior surface defining a generally rectangular slot, said slot configured to receive an end of a pull tab of said beverage can.

21. A method for cleaning the top of a beverage can, the top having a central surface and an axially extending annular rim surrounding the surface, the method comprising the steps of:

providing a cleaning sponge having an exterior upwardly extending annular cleaning rib, an interior upwardly extending annular cleaning rib and a rim-receiving groove disposed therebetween said groove having a bottom.

grasping the cleaning sponge;

positioning the sponge adjacent the top of the beverage can with the rim of the can disposed completely within the groove of the sponge;

pressing the sponge against the container;

rotating the sponge relative to the can while keeping the rim of the can within the groove of the sponge.

22. The method for cleaning the top of a beverage can of claim 21 wherein the providing step includes making the interior cleaning rib extend approximately 0.23 inches above the bottom of the groove.

23. The method for cleaning the top of a beverage can of claim 21 which, after the providing step, further includes the steps of:

providing a container having walls and a bottom, the walls defining a generally circular opening opposite the bottom;

providing spikes extending upwardly from the bottom of the container; and, placing the sponge inside the container with the spikes contacting the sponge and with the cleaning ribs of the sponge facing away from the bottom.

24. The method for cleaning the top of a beverage can of claim 23 wherein the grasping step is done by grasping the walls of the container.

25. The method for cleaning the top of a beverage can of claim 24 further including the step of openably covering the opening of the container with a lid when the device is not in use.

26. A device for cleaning the top of a beverage can, comprising:

absorbent, resilient cleaning means having a cleaning portion and a base portion, the cleaning portion including an interior upwardly extending annular cleaning rib, an exterior upwardly extending annular cleaning rib, and a rim-receiving groove disposed therebetween, and wherein said interior annular rib defines a central, circular and substantially planar surface which is lower than said groove.

27. The device for cleaning the top of a beverage can of claim 26 wherein the central surface is concave.

* * * * *

UNITED STATES PATENT AND TRADEMARK OFFICE

CERTIFICATE OF CORRECTION

PATENT NO. : 4,802,927

DATED : February 7, 1989

INVENTOR(S) : Gary W. Barbour

It is certified that error appears in the above-identified patent and that said Letters Patent is hereby corrected as shown below:

In column 4, line 60, please change "flage" to --flange--.

In column 5, line 19, before the period please insert: --; and, pull tab means for pulling said pull tab--.

Signed and Sealed this

Fourth Day of July, 1989

*Attest:*

*Attesting Officer*

DONALD J. QUIGG

*Commissioner of Patents and Trademarks*